US005970153A

United States Patent [19]

Petroff

[11] Patent Number: 5,970,153

[45] Date of Patent: Oct. 19, 1999

[54] STEREO SPATIAL ENHANCEMENT SYSTEM

[75] Inventor: Michael L. Petroff, West Hills, Calif.

[73] Assignee: Harman Motive, Inc., Martinsville, Ind.

[21] Appl. No.: 08/857,516

[22] Filed: May 16, 1997

[51] Int. Cl.[6] ..... H04R 5/00

[52] U.S. Cl. ..... 381/17; 381/28

[58] Field of Search ..... 381/17, 28–120

[56] References Cited

U.S. PATENT DOCUMENTS

| | | | |
|---|---|---|---|
| 4,329,544 | 5/1982 | Yamada | 381/17 |
| 4,812,921 | 3/1989 | Mitsuhashi | 381/17 |
| 5,524,053 | 6/1996 | Iwamatsu | 381/17 |

*Primary Examiner*—Minsun Oh Harvey
*Attorney, Agent, or Firm*—J. E. McTaggart

[57] ABSTRACT

A stereophonic signal processing system provides optimal spatial enhancement in a compact stereo sound system having limited physical separation between two relatively small stereo loudspeakers with accordingly limited low-frequency output capability. A difference signal is derived from the left and right stereo signals by subtraction in a a differential amplifier circuit, which may be made frequency-dependent so that the rejection of correlated information decreases with increasing frequency. The difference signal is processed through a frequency equalizer circuit, and an inverted version is derived via an inverter; the non-inverted and inverted difference signals are filtered according to a high-pass filter function having an upper-bass cutoff frequency selected to avoid excessive spatialization at low frequencies. The left and right stereo signals are filtered according to a transfer function having low-bass cutoff frequency selected to minimize reproduction distortion by minimizing low frequency signal components below an effective frequency range of the loudspeakers. The filtered stereo signals are separately mixed in optimal proportion with the equalized and filtered difference signals, thereby providing optimal spatial enhancement for small and closely-spaced stereo loudspeakers.

21 Claims, 5 Drawing Sheets

STEREO SPATIAL ENHANCEMENT SYSTEM

FIELD OF THE INVENTION

The present invention relates to stereophonic sound reproduction and more specifically to a signal process for providing optimal spatial enhancement in a compact stereo sound system having limited physical separation between two stereo loudspeakers with inherent low-frequency limitations due to relatively small size.

BACKGROUND OF THE INVENTION

Compact integrated sound systems, such as those incorporated in personal computers, portable televisions and portable stereos, generally provide limited physical separation between the stereo speakers and a correspondingly small angle between the speakers and the listener. It follows that with such compact sound systems the "spatialization", which is defined as the width of the perceived sound stage, will be generally perceived by the listener as inferior to that of larger systems. Additionally, small sound systems generally utilize small stereo loudspeakers with limited low-frequency capability.

Correlated information is typically generated when a recording engineer balances a lead instrument or instruments equally on both stereo channels so that the listener will perceive such instruments as a center image when reproduced by the stereo speakers.

In small sound systems having limited physical separation between the stereo speakers, the stereo signals can be processed in a manner to enhance spatialization; in such an enhancement signal process, a high degree of rejection of correlated information serves to prevent excessive spatialization of such correlated information, which in turn preserves the center image of lead instruments as intended during the recording process. At the same time, however, a high degree of rejection of correlated information excessively reduces the spatialization of correlated reverberation sound components.

It has been demonstrated that human hearing is most sensitive to spatial information at lower-midrange frequencies and is most sensitive to reverberant information at upper-midrange frequencies. It follows that a high degree of rejection, of correlated information below a lower-midrange frequency and a reduced degree of such rejection of correlated information above such lower midrange frequencies serve to optimally spatialize stereophonic information as well as correlated reverberant information in small sound systems.

It is known that the ability of a loudspeaker to accurately reproduce lower-midrange frequencies is crucial to the reproduction of spatially enhanced music. It is also known that the ability of small loudspeakers to accurately reproduce such lower-midrange frequencies is compromised when low-bass signals are present in the loudspeaker driving signals. Since small loudspeakers are not typically capable of providing audible low-bass acoustic output, such low-bass signals may be attenuated in the left and right loudspeaker driving signals as a means to improve spatial reproduction without affecting the audible bandwidth of the loudspeaker. It has been determined by the present inventor that an optimum low-bass cutoff frequency, typically between 35 Hz and 70 Hz, exists for the left and right stereo signal components of loudspeaker driving signals, and an optimum upper-bass cutoff frequency, typically between 80 160 Hz, exists for the derived difference signal components of such driving signals. This difference in optimum cutoff frequency occurs as a result of the oppositely polarized relationship of the derived left and right difference signals, whereby high-pass filtering at an upper bass frequency is required to prevent stereophonic acoustic cancellation, and a corresponding reduction in sound pressure level below such upper bass frequency.

DISCUSSION OF KNOWN ART

Prior art circuits have provided stereo channel cross-coupling or difference signal enhancement to provide improved spatialization for sound systems in the general case as opposed to optimal spatialization for small sound systems having limited physical separation between small loudspeakers. Circuitry of known art for providing a spatial enhancement effect commonly adds difference signals to the stereo signals: a pair of oppositely polarized difference signals, L−R and R−L, are derived from the stereo signal, typically using a differential amplifier and inverter, and these difference signals are added to the stereo input signals to provide altered stereo output signals L+a(L−R) and R+a(R−L) wherein the channel-to-channel signal correlation is reduced by an amount depending on the gain factor "a" thus increasing the spatialization effect such that sound images within each half of the perceived "sound stage" are shifted outwardly toward the stage ends. Gain "a" is typically made to be in the order of 1.0. In a particular circuit of known art, gain "a" is made variable by means of a "mixture ratio setter" to adjust the spatialization effect.

The CMRR (common mode rejection ratio) of the differential amplifier typically provides a high degree of rejection of correlated information in the derived difference signal, the rejection being constant relative to frequency throughout the audio spectrum, and therefore such correlated information is not spatially enhanced.

It follows that lead instruments, which are generally recorded equally on both channels and thereby constitute correlated information, are not spatially enhanced and thus perceived as center images between the stereo speakers as intended in the recording process.

In U.S. Pat. No. 4,303,423, Cohen discloses a stereo enhancement system in which a derived stereophonic difference signal is time-delayed and mixed in an out-of-phase manner with the left and right stereo signals to provide spatial enhancement.

In U.S. Pat. No. 4,394,536 Shima discloses a sound reproduction device in which a derived stereophonic difference signal and a reverberated, time-delayed signal are mixed in an out-of-phase manner with the left and right stereo signals to provide spatial enhancement.

In U.S. Pat. No. 4,394,537 Shima discloses an alternative sound reproduction device in which a derived stereophonic difference signal, and a reverberated time-delayed signal, are mixed in an out-of-phase manner with the left and right stereo signals to provide spatial enhancement.

In U.S. Pat. No. 4,815,133 Hibino discloses a sound field reproducing apparatus in which a derived stereophonic difference signal is mixed, at variable mixture ratios, in an out-of-phase manner with the left and right stereo signals to provide spatial enhancement.

Generally in the above mentioned and other known art in this field, differential amplifier circuits for deriving difference signals providing stereophonic spatial enhancement are characterized as having substantially constant common mode rejection across the audio frequency range.

OBJECTS OF THE INVENTION

It is a primary object of the present invention to disclose a stereophonic signal processing system, to be interposed in a dual channel stereo signal path, that derives a pair of oppositely polarized modified difference signals and combines them with the stereo signals in a manner to provide spatial enhancement in a small stereo sound system having limited physical separation between two small stereo loudspeakers.

It is a further object of the present invention to describe, as a basic functional block of the invention, a differential amplifier/equalizer circuit for deriving a modified difference signal in which the rejection of correlated information may vary as a function of frequency, and in which frequency equalization is applied to the derived difference signal component.

It is yet a further object to implement the differential amplifier/equalizer circuit by a single op-amp (operational amplifier) stage.

It is another object to provide, in the system of this invention, low-bass cutoff means for attenuating low frequency content below an effective frequency range of the loudspeakers.

It is a still further object of the present invention to process the stereo signal in accordance with a first transfer function provided by high-pass filter means having a designated low-bass cutoff frequency and to process the difference signal in accordance with a second transfer function provided by high-pass filter means having a designated upper-bass cutoff frequency.

It is yet another object of the present invention to provide a dual-transfer-function high-pass filter/mixer, two of which are used as functional blocks in a preferred embodiment of the invention, each adding one of a pair of oppositely-polarized derived modified difference signals to the corresponding stereo channel output in a manner to also implement the function of the low-bass cutoff means in each stereo channel and to implement the function of the upper-bass cutoff means in each modified difference signal path.

It is a further object to implement the dual transfer functions, i.e. both the first and second function high-pass filters, along with the associated mixer, in a single stage utilizing a single op-amp (integrated circuit operational amplifier) and peripheral passive components, in a dual-transfer-function circuit module.

It is another object of the present invention to describe, for use in the system, a differential amplifier circuit for deriving a difference signal in which the rejection of correlated information may be made constant relative to frequency, and to describe a separate equalizer circuit that processes such derived difference signal component.

SUMMARY OF THE INVENTION

Spatial enhancement for small stereo sound systems having limited physical separation between two small stereo loudspeakers has been accomplished in a preferred embodiment of the present invention having a DE (differential amplifier/equalizer) circuit module deriving a difference signal, an inverter providing an inverted difference signal, and a pair of DT (dual-transfer-function mixer) modules, each receiving left and right stereo signals respectively at a first input node, and each receiving the difference signal and the inverted difference signal at second input nodes. Each DT module is implemented by a single op-amp circuit that introduces a first high-pass filter function with a low-bass cutoff frequency acting on each of the stereo signals and a second-high pass filter function with an upper-bass cutoff frequency acting on the difference signals.

A first implementation of the DE circuit module utilizes two op-amp stages: the first stage performs the difference function and the second stage introduces shelved equalization, boosting frequencies of the difference signals below a designated midrange region.

A second implementation of the DE circuit module utilizes only a single op-amp stage and introduces frequency dependence in the difference function such that the CMRR (common mode rejection ratio) and thus the rejection of correlated stereo information in the difference signal output typically decreases with increasing frequency, acting to preserve the center image of lead instruments without excessively reducing correlated reverberant information.

BRIEF DESCRIPTION OF THE DRAWINGS

The above and further objects, features and advantages of the present invention will be more fully understood from the following descriptions taken with the drawings, in which designated letters and numbers correspond to all like letters and numbers in the text, and in which.

DETAILED DESCRIPTION

Figure 1:
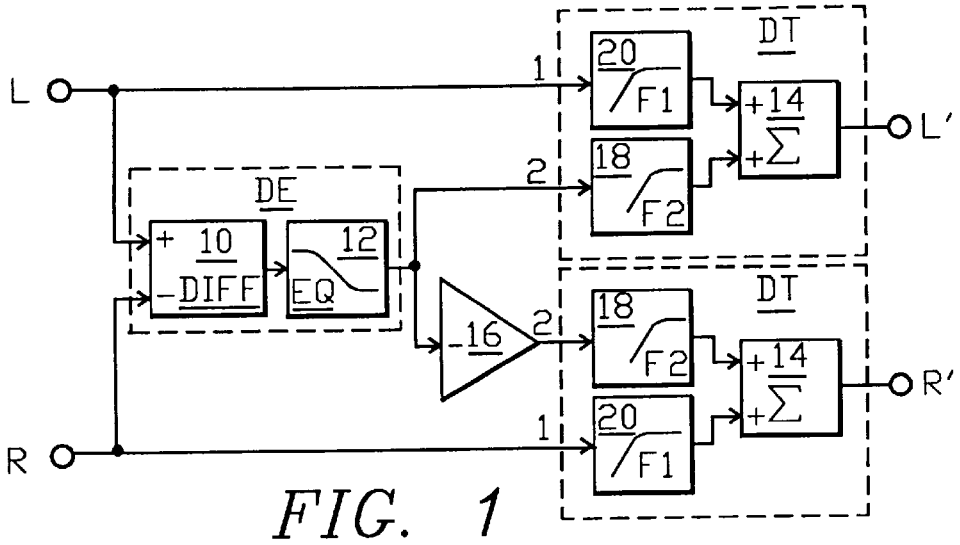
FIG. 1 is a functional block diagram of a preferred embodiment of the stereo enhancement system of the present invention utilizing a DE (differential amplifier/equalizer) circuit module, an inverter and two DT (dual-transfer-function) circuit modules.

FIG. 1 is a functional block diagram of a preferred embodiment of a stereo enhancement system of the present invention, showing left and right input stereo signals L and R applied to + and − input nodes of a module DE in which the functions of subtracting and equalizing are performed, as indicated symbolically by differential stage 10 and equalization stage 12. The L and R stereo signals are also each applied to first input nodes 1 of corresponding left and right dual-transfer function circuit modules DT, while the difference signal from module DE and the inverted difference signal from inverter 16 are applied to second input nodes 2 of the left and right circuit modules DT respectively.

In each module DT the stereo channel signal at input node 1 is high-pass filtered in circuit block 20 according to a first high-pass transfer function F1 having a designated low-bass cutoff frequency, and the equalized difference signal at input node 2 is high-pass filtered in circuit block 18 according to a second high-pass transfer function F2 having an upper-bass cutoff frequency that is made to be higher than the low-bass cutoff frequency by a designated amount. The left and right channel summing circuits 14 add the corresponding filtered stereo signal and filtered difference signal together in a predetermined proportion, thus providing the processed stereo output signals L' and R' respectively.

The transfer function F1 in the high-pass stereo-signal filter block 20 is made to have a low-bass cutoff frequency within a range of about 35 to 70 Hz corresponding to the lower limit of the effective audio frequency range of the loudspeakers.

The transfer function F2 in the high-pass difference-signal filter is made to have a cutoff frequency within a range of about 80 to 160 Hz so as to minimize the reproduction of oppositely phased difference signals below the upper-bass cutoff frequency. The resulting loss of stereo separation in the low bass frequency range is acceptable since such frequencies tend to be non-directional and relatively unimportant in stereo imaging and spatialization.

Figure 2:
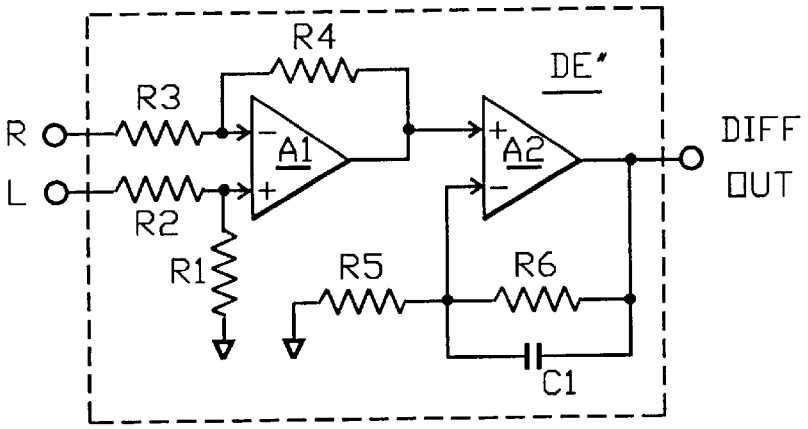
FIG. 2 is a schematic diagram of the DE module of FIG. 1 implemented as a DE" circuit module having two op-amp stages.

FIG. 2 is a schematic diagram of two-stage differential amplifier/equalizer module DE" which is a particular implementation of module DE of FIG. 1 wherein the functions of differential amplifier 10 and equalizer 12 are implemented separately by op-amps A1 and A2, peripheral resistors R1–R6, and capacitor C1. Op-amp A1 operates in a wide-band flat-frequency-response mode (refer to FIG. 4, curve 1), delivering an unaltered difference signal to equalizer 12 which in turn delivers an equalized difference signal to the + input node of op-amp A2. If resistor R2 is made equal to R3, and R1 is made equal to R4, then, assuming precision resistors, the + and – inputs of op-amp A1 are balanced with respect to gain and thus the rejection of correlated information is maximum, approaching the inherently high common mode rejection ratio (CMRR) of op-amp A1, in the order of 60 dB, which acts to reject correlated stereo signal content from entering the difference signal path.

While the functions of a differential amplifier 10 and equalizer 12 are shown implemented separately in FIGS. 1 and 2, these functions can be implemented in combination.

Figure 3:
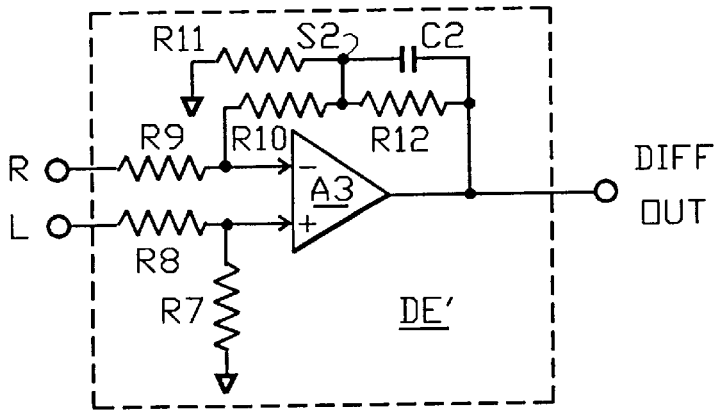
FIG. 3 is a schematic diagram of a DE module of FIG. 1 implemented as a DE' circuit module having a single op-amp stage.

FIG. 3 is a schematic diagram of a differential amplifier/equalizer circuit module DE' which is an alternative implementation of module DE (FIG. 1) wherein both the differential amplifier function and the equalizer function are performed by a single op-amp A3 and peripheral components: resistors R7–12 and C2.

Left and right stereo input signals L and R are applied respectively to the + and – input nodes of differential op-amp A3 through resistors R8 and R9 which form input-attenuating voltage dividers in conjunction with resistors R7 and a feedback network that includes RIO. A modified difference signal at the output of stage A3 is applied to the feedback network consisting of resistors R12, R11 and capacitor C2. The signal at the junction of R11, R12 and C2, is applied through negative feed-back resistor R10 to the – input of op-amp A3. This feedback network results in attenuation of frequencies above the lower-midrange region in the difference signal (refer to FIG. 4, curve 2).

If resistors R8 and R9 are made equal, and R7 is made equal to the total feed-back resistance consisting of R10 added to the parallel combination of R11 and R12, then, at frequencies below a lower-midrange region where capacitor C2 has a high reactance and does not substantially affect resistor combination R11 and R12, the + and – input gains of op-amp A3 will be substantially balanced, resulting in a high value of CMRR (common mode rejection ratio) and a correspondingly high rejection of correlated information into the difference signal path below the lower midrange region. The + and – input gains of op-amp A3 may be made unbalanced initially at an initial value and polarity so as to establish a reference value of CMRR. At frequencies above such lower-midrange region where capacitor C2 has a low reactance and substantially lowers the impedance across R12 however, the CMRR and thus the rejection of correlated information will be reduced above such lower midrange region (refer to FIG. 5, curve 3). R7 may be optionally made substantially unequal to the above described total feed-back resistance, in which case the rejection of correlated information can be made to vary by an alternative function relative to frequency.

Figure 4:
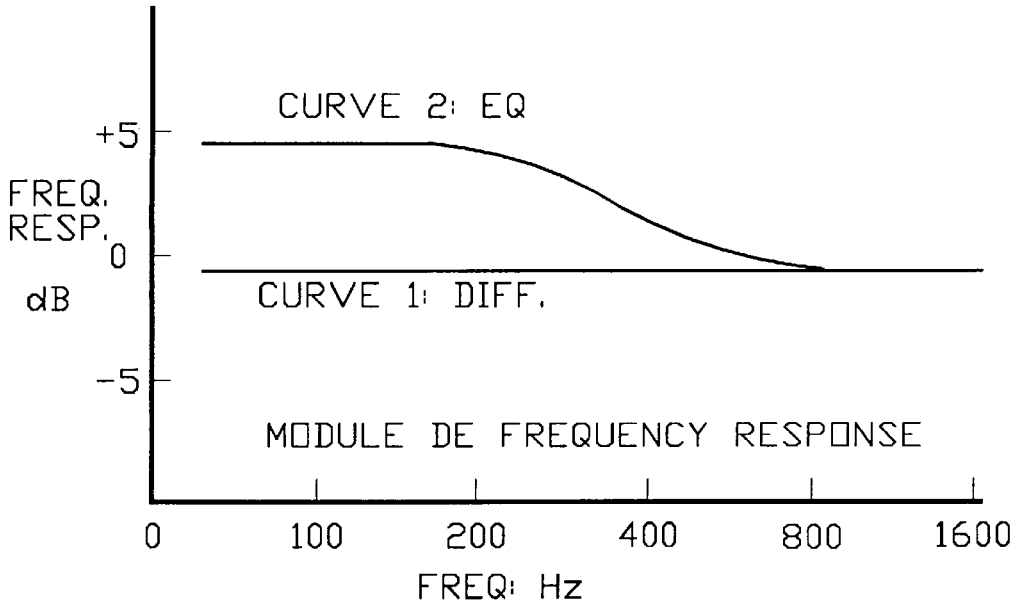
FIG. 4 is a graph showing frequency response curves pertaining to the circuit modules in FIG. 2 and FIG. 3.

The graph of FIG. 4 shows frequency response curves for the two stages of module DE" of FIG. 2: curve 1 for the differential stage A1 is essentially flat in response, and curve 2 for the equalizer stage 12 has a low frequency shelf that is boosted about 5 dB above the high frequency baseline; the high/low transition frequency of curve 2 is typically centered somewhere above 200 Hz, as determined primarily by C1 and R6. The maximum gain of curve 2 at the low frequency shelf is determined by the ratio R6/R5 in the equalizer stage 12. The minimum gain at high frequencies is typically made to be unity. The equalization can be optimized by judicious component value assignment.

Figure 5:
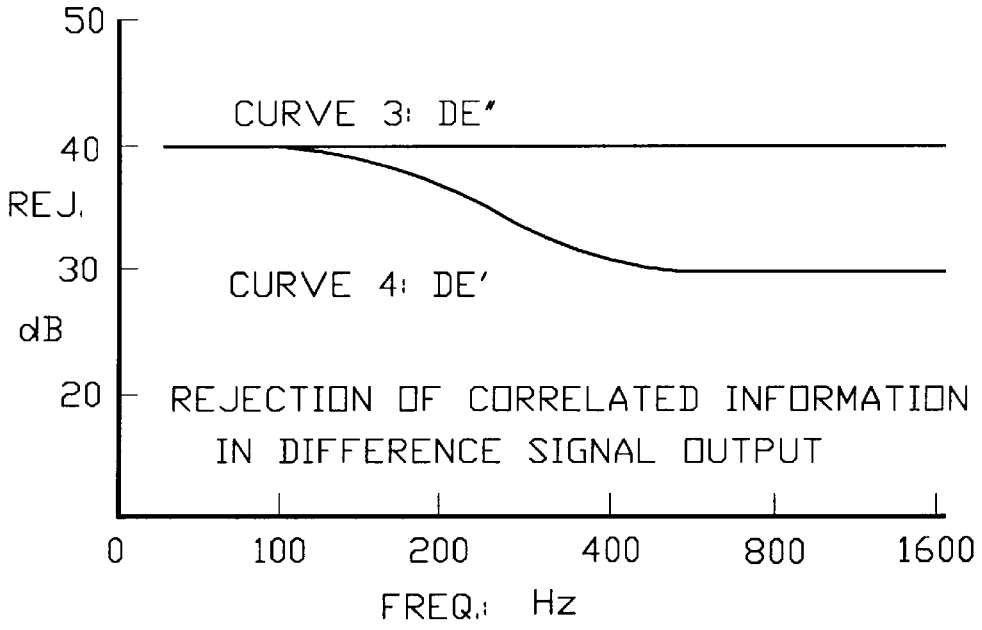
FIG. 5 is a graph showing curves of rejection of correlated information versus frequency in the derived difference signal in connection with the circuit modules in FIGS. 2 and 3.

In the graph of FIG. 5, curves 3 and 4 show rejection of correlated stereo information entering the difference signal path for module DE" of FIGS. 2 and for module DE' of FIG. 3 respectively. For the two-stage module DE" of FIG. 2, wherein the feedback circuitry around op-amp A1 stage is entirely resistive, curve 3 exhibits constant rejection of about 40 dB independent of frequency, while for the single stage module DE' of FIG. 5, wherein the feedback circuitry around op-amp A3 comprises both resistive and capacitive elements, curve 4 shows the common mode rejection decreasing with increasing frequency due to the influence of capacitor C2 on the input balance of stage A3. This effect acts in a manner to preserve correlated reverberant information at crucial upper midrange and high frequencies.

In the single-stage module DE' (FIG. 3) the equalization and the common mode rejection are inter-related with regard to frequency dependence.

In the two-stage module DE" (FIG. 2), as an alternative to the flat frequency response of the CMMR (common mode rejection ratio) described above, the CMMR could be made to vary with frequency in a manner that is independent of the equalizer stage frequency response by introducing one or more reactive components, i.e. capacitor or inductance, in the differential stage 10, e.g. in parallel or series with in the feedback resistor R4.

Figure 6:
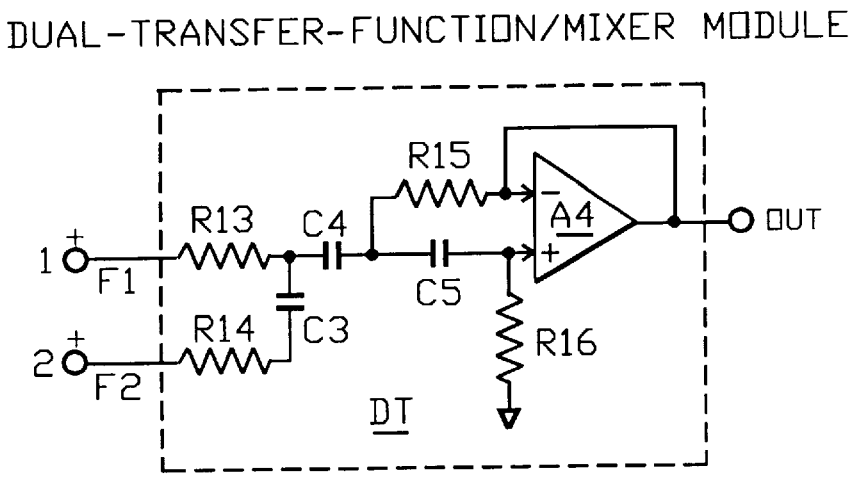
FIG. 6 is a schematic diagram of a preferred implementation of each dual-transfer-function high-pass filtered summing circuit block DT: two utilized in FIG. 1.

FIG. 6 is a schematic block diagram of a dual-transfer function/summing circuit module DT, that is implemented by a single op-amp A4. This implementation is utilized in the preferred embodiment (FIG. 1): typically a pair of such modules serve as output stages of the enhancement system, delivering the L' and R' modified stereo output signals.

The stereo signal applied to input node 1 proceeds through a series network consisting of resistor R13 and capacitors C4 and C5 to the + input node of amplifier A4, returned to ground through resistor R16, and additionally feedback resistor R15 is connected from the A4 output to the junction of C4 and C5. This circuit acts on the stereo signal according to a first transfer function 1: a high pass filter function that attenuates at frequencies below a predetermined low bass cutoff frequency.

The difference signal applied to input node 2 proceeds through resistor R14 and capacitor C3 to the junction of R13 and C4 which is a summing point of the two inputs, since module DT also serves as an audio mixer to sum the two input signals. This circuitry acts on the stereo signal according a second transfer function F2: a high pass filter that attenuates below a predetermined high bass cutoff frequency.

Figure 7:
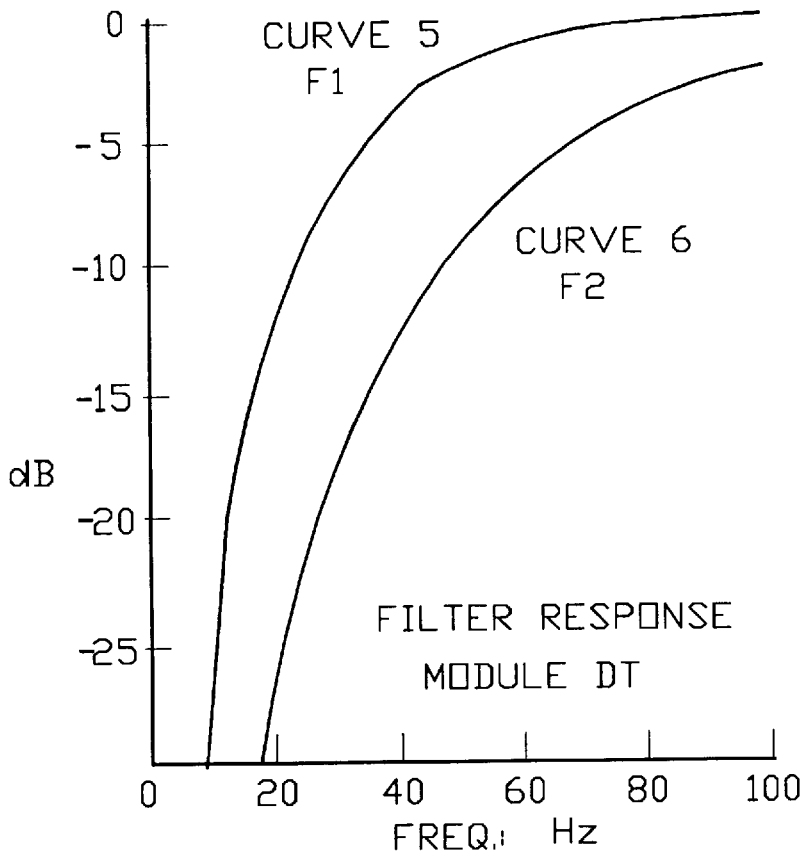
FIG. 7 is a graph showing frequency response curves of the low-bass stereo signal transfer function F1 and the upper-bass difference signal transfer function F2 of module DT in FIGS. 1 and 6.

In the graph of FIG. 7, curve 5 shows a typical response of the high-pass low-bass transfer function F1, corresponding to input port 1 of FIG. 6, having a −3 dB cutoff frequency at approximately 35 to 70 Hz. Curve 6 shows a typical response of the high-pass upper-bass transfer function F2 corresponding to input node 2 of FIG. 6, having a −3 dB cutoff frequency at approximately 80 Hz to 160 Hz.

Figure 8:
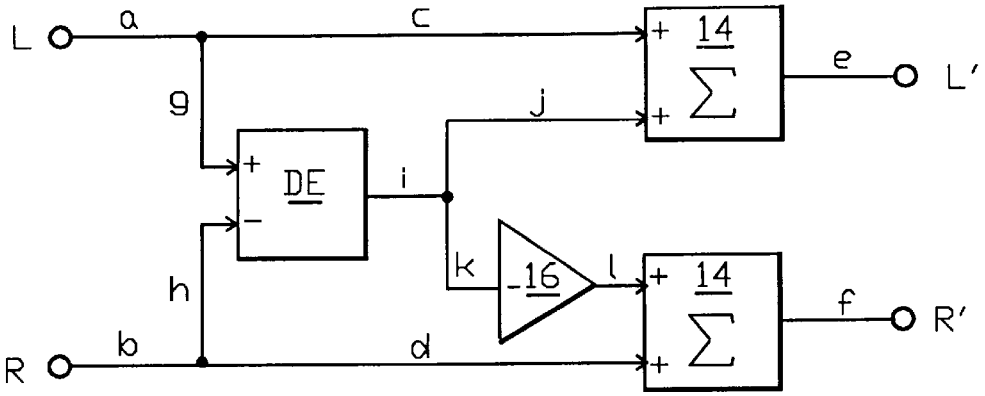
FIG. 8 is an analytic block diagram of the basic stereo enhancement system identifying twelve basic circuit branches.

FIG. 8 is an analytic block diagram of the basic stereo enhancement system in which twelve circuit branches are designated a through l.

In the embodiment utilizing modules DT (FIGS. 1 and 6), low-bass filter blocks 20, providing transfer function F1, are deployed in central branches c and d, while the upper-bass filter blocks 18, providing transfer function F2, are deployed in branches j and l.

Alternatively, instead of incorporating filter blocks 18 and 20 in modules DT, either or both may be deployed as separate circuit blocks in the same branches or in equivalent alternative branches.

Blocks 20 may be deployed in input branches a and b, central branches c and d or in output branches e and f. Similarly blocks 18 could be deployed in branches g and h, j and k, j and l or a single block 18 could be deployed in branch i. Thus equivalent functional performance is available in each of twelve possible circuit combinations: 3 choices for block 20 multiplied by 4 choices for block 18.

Figure 9:
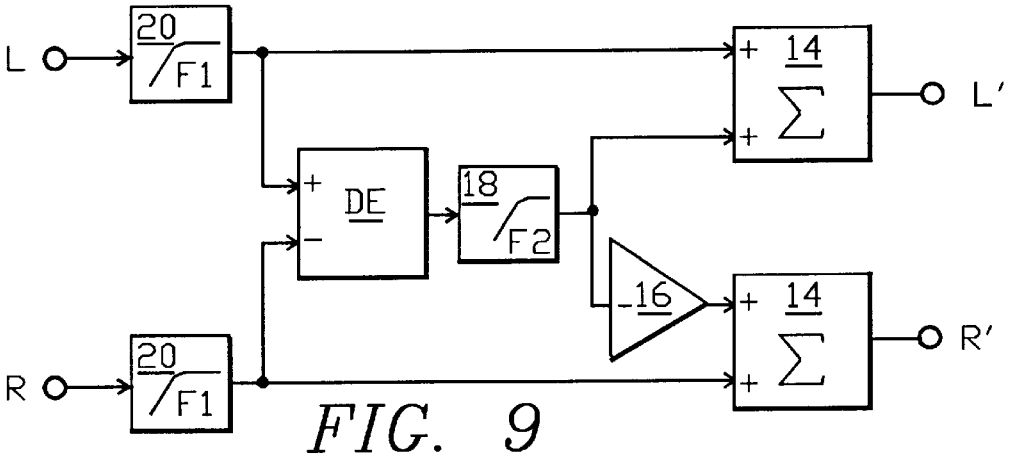
FIGS. 9 and 10 are functional block diagrams showing examples of alternative embodiments not utilizing DT modules but instead deploying F1 and F2 transfer-function filter blocks in different circuit branches shown in FIG. 8.

FIG. 9 is a functional block diagram showing the example of locating the blocks 20 in the input branches a and b (FIG. 8) and locating a single block 18 in branch i which is the output branch of module DE before splitting to left and right difference signal branches j and k.

Figure 10:
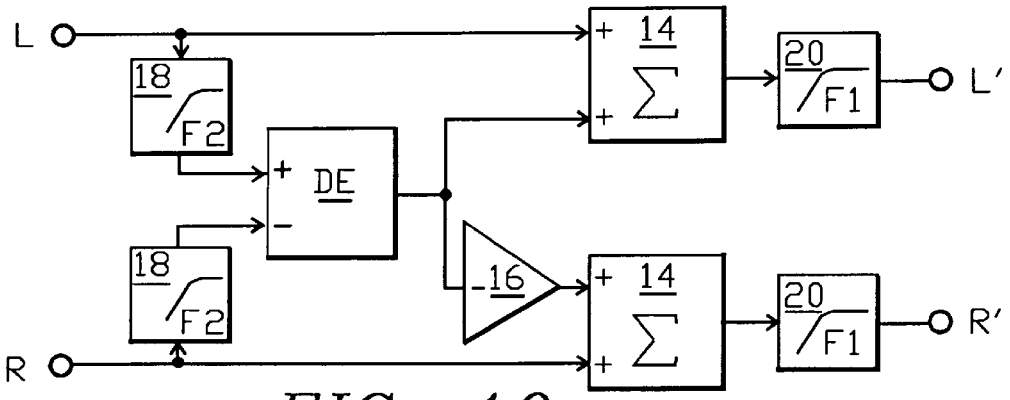

FIG. 10 is a functional block diagram showing the example of locating blocks 20 in the output branches e and f and locating the blocks 18 in difference signal branches g and h: the input branches of module DE.

Figure 11:
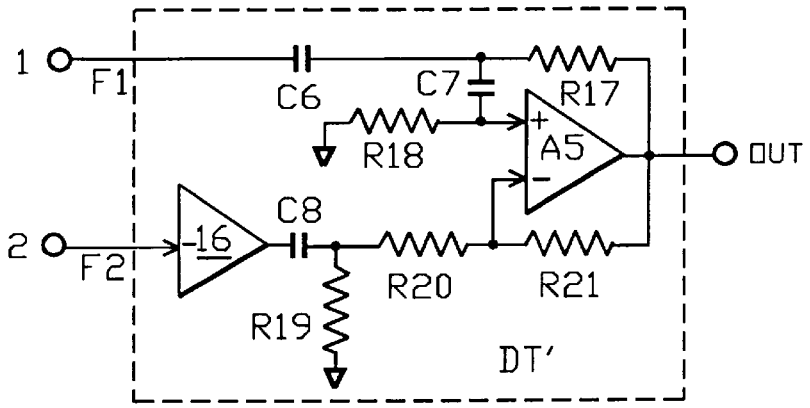
FIG. 11 is a schematic diagram of a dual-transfer-function high-pass filtered summing block DT': an alternative implementation of module DT in FIG. 6.

FIG. 11 is a schematic diagram of an dual-transfer function high-pass filtered summing circuit module DT', an alternative implementation for module DT (FIG. 6) utilizing an inverter 16 at input node 2.

The stereo signal, applied to input node 1, is directed through C6 and C7 to the + input node of op-amp A5; R17 and R18 in conjunction with C6 and C7 establish the required low-bass high-pass filter function F1.

The difference signal, applied to node 2, is directed via inverter 16 through C8 and R20 to the − input node of op-amp A5; R19, R20 and R21, in conjunction with C8, establish the required upper-bass high-pass filter function F2, and A5 introduces an inversion that cancels the input inversion introduced by inverter 16.

Figure 12:
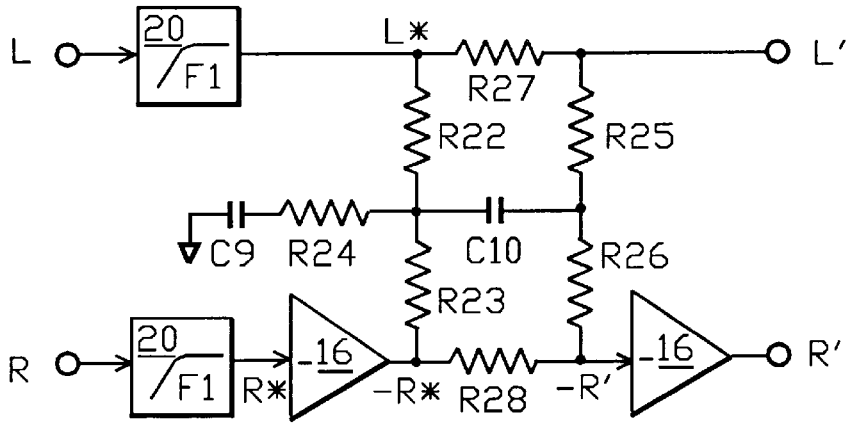
FIGS. 12 and 13 are schematic block diagrams of two versions of an alternative circuit embodiment of the present invention not utilizing DT modules.

FIG. 12 is a schematic/block diagram of another implementation of the stereo enhancement system of the present invention wherein one of the stereo channels is inverted and added to the opposite channel in a passive adding network to derive the desired difference signal. The component values in the passive adding network are dimensioned so as to provide the required difference-signal equalization and filtering.

The left stereo input signal L is applied to left filter 20 thus providing a filtered left stereo signal L*. The right stereo input signal R proceeds through right filter 20 and becomes inverted by inverter 16 so as to provide an inverted filtered right stereo signal −R*.

A subtraction function is obtained by adding the oppositely-phased signals L* and −R* in a resistive mixer/equalizer network of the present circuit that functions as a passive equivalent of the differential amplifier/equalizer circuit module DE and further serves to mix such derived equalized difference signal in opposite-phase relationship with the left non-inverted filtered stereo signal L* and with the right inverted filtered stereo signal −R*.

The oppositely-phased signals L* and −R* are summed by R22 and R23, providing a difference signal L*−R* at their junction. The difference signal is equalized by the series branch through R24 and C9 to ground, such that frequencies below a lower-midrange region are intensified relative to frequencies above such lower-midrange region. The L*−R* difference signal is high-pass filtered with an upper bass cutoff frequency by capacitor C10 in conjunction with R25 and R26: thus this capacitive filtering provides a filtered difference signal which, through R25, becomes summed separately with the filtered left stereo signal L* from R27, providing the modified left output signal L' at the junction of R25 and R27 as a spatially-enhanced left stereo output signal, and through R26 the difference signal becomes summed separately with the inverted filtered right signal −R* from R28, providing the inverted modified right signal −R' at the junction of R26 and R28 as a spatially-enhanced right signal.

Figure 13:
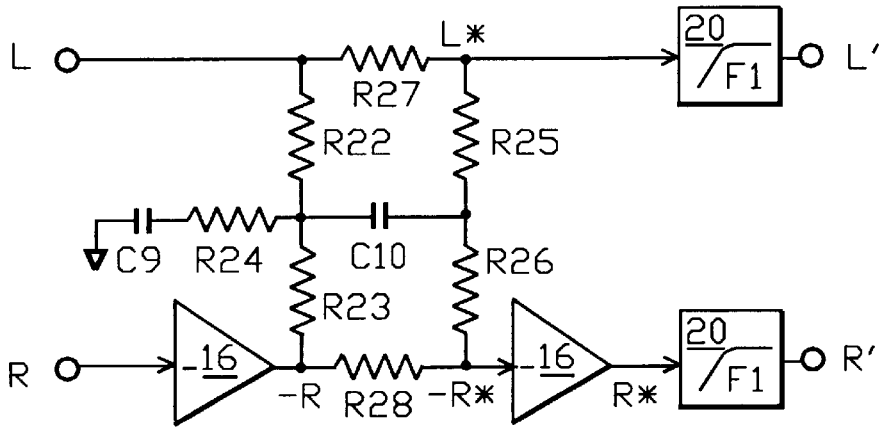

FIG. 13 shows an alternative version of the circuitry of FIG. 12 with the low-bass high-pass F1 filter blocks 20 relocated from the input branches of the system to the output branches thereof. As a further alternative, in the right channel, the circuit locations of the inverter block 16 and filter block 20 at the output could be interchanged.

Typically in FIGS. 12 and 13, R22=R23, R25=R26 and R27=R28. C10 may be optionally by-passed and eliminated. The inverter 16 at the output could be omitted: the right output signal would be inverted (−R') but an inversion could be subsequently introduced in the power amplifier or by reverse-connecting the right loudspeaker.

In any of the above embodiments shown utilizing the differential amplifier/equalizer circuit module DE as described in connection with FIG. 1, there exists the option of utilizing either the single stage module DE' as described in connection with FIG. 3, featuring frequency-dependent rejection of correlated information, or the two stage module DE" as described in connection with FIG. 2, featuring a separate equalizer stage so that rejection of correlated information in the differential stage can be held constant relative to frequency, or, as described above, could be made to vary with frequency independent of equalizer 12.

In any system embodiment of the invention, "left" and "right" designations could be interchanged throughout the system without departing from the principles of the invention since it is normally desired to maintain left/right symmetry. However deliberate asymmetry may be readily introduced by those skilled in audio and electronics as a matter of design choice, for particular purposes and special acoustic environments.

There are numerous other combinations of inverters and inverting op-amp circuitry that can be made equivalent to circuitry shown above for accomplishing the essential functions for practicing the present invention, considering that each pair of inversions in a signal path tend to cancel each other.

The invention may be embodied and practiced in other specific forms including digital signal processing, without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A stereophonic signal processing system, for enhancing spatial qualities of reproduced sound in a compact stereo sound system having stereo loudspeakers driven by a stereo power amplifier, said signal processing system comprising:

first and second input ports receiving first and second stereo signals from a stereo signal source;

first and second output ports driving the stereo power amplifier;

a differential amplifier, receiving the first and second stereo signals as inputs, configured and arranged to subtract the second signal from the first signal so as to derive and provide therefrom a difference signal wherein rejection of correlated stereo signal content is made to vary with frequency in a predetermined manner;

a difference-signal equalizer circuit configured and arranged to equalize the difference signal in accordance with a step-equalized low-boost frequency response, providing an equalized difference signal at an equalizer output node;

an inverter circuit configured and arranged to invert the equalized difference signal and to thus provide an inverted equalized difference signal;

difference-signal filter means configured and arranged to filter the equalized difference signal and the inverted equalized difference signal in accordance with a difference-signal transfer function defining a high-pass filter having a designated upper-bass cutoff frequency, thus providing an equalized filtered difference signal and an inverted equalized filtered difference signal;

a first summing circuit, having a stereo-signal input node receiving substantially the first stereo signal and a difference-signal input node receiving the equalized filtered difference signal, configured and arranged to sum the first stereo signal and the equalized filtered difference signal and to thus provide therefrom a first spatially-enhanced stereo output signal of said processing system; and a second summing circuit, having a stereo-signal input node receiving the second stereo signal and a difference-signal input node receiving the inverted equalized filtered difference signal, configured and arranged to sum the second stereo signal and the inverted equalized filtered difference signal and to thus provide therefrom a second spatially-enhanced stereo output signal of said processing system.

2. The stereophonic signal processing subsystem as defined in claim 1 further comprising:

stereo-signal filter means constructed and arranged to separately filter the first and second stereo signals in a like manner in accordance with a stereo-signal transfer function defining a high-pass filter having a designated low-bass cutoff frequency that is lower than the upper-bass cutoff frequency by a predetermined amount;

whereby signal components having low frequency below a minimum effective frequency of the loudspeakers are attenuated so as to minimize reproduction distortion.

3. The stereophonic signal processing system as defined in claim 2 wherein said stereo-signal filter means comprises a like pair of stereo-signal filter circuits, interposed respectively in first and second stereo signal paths between the input ports and the output ports of said processing system, constructed and arranged to provide the stereo-signal transfer function.

4. The stereophonic signal processing system as defined in claim 3 wherein each of said stereo-signal filter circuits is connected in series between a corresponding one of said input ports of said system and a circuit node that includes a corresponding input node of said differential amplifier and a first input node of a corresponding one of said summing circuits.

5. The stereophonic signal processing system as defined in claim 3 wherein each of said stereo-signal filter circuits is connected between a stereo signal input node of a corresponding one of said summing circuits and a circuit node that includes an input node of said differential amplifier and a corresponding one of said input ports of said processing system.

6. The stereophonic signal processing system as defined in claim 3 wherein each of said stereo-signal filter circuits is connected between a corresponding one of said output ports of said processing system and an output node of a corresponding one of said summing circuits.

7. The stereophonic signal processing system as defined in claim 1 wherein said differential amplifier is constructed and arranged to provide a designated decreased amount of rejection of correlated stereo signal content in the difference signal at frequencies above a predetermined midrange frequency compared to such rejection at frequencies below the predetermined midrange frequency.

8. The stereophonic signal processing system as defined in claim 1 wherein said differential amplifier and said difference-signal equalizer circuit are implemented together in a single stage differential-equalizer circuit module, utilizing a single differential op-amp device and associated passive components.

9. The stereophonic signal processing system as defined in claim 1 wherein said differential amplifier and said difference-signal equalizer circuit are implemented together in a two-stage circuit block having a first stage, utilizing a first op-amp device and associated passive components, configured and arranged to constitute said differential amplifier, and a second stage, utilizing a second op-amp device and associated passive components, configured and arranged to constitute said difference-signal equalizer circuit.

10. The stereophonic signal processing system as defined in claim 1 wherein said difference-signal filter means comprises a like pair of difference-signal filter circuits, each interposed in series respectively at a like location in a corresponding difference signal path between one of said system input ports and the difference-signal input node of corresponding one of said summing circuits.

11. The stereophonic signal processing system as defined in claim 10 wherein each of said difference-signal filter circuits is interposed in the corresponding signal path between a corresponding one of said system input ports and a corresponding one of the input ports of said differential amplifier.

12. The stereophonic signal processing system as defined in claim 10 wherein each of said difference-signal filter circuits is interposed in a corresponding signal path between the equalizer output port and the difference-signal input node of a corresponding one of said summing circuits.

13. The stereophonic signal processing system as defined in claim 1 wherein said difference-signal filter means comprises a difference-signal filter circuit interposed between the equalizer output node and a difference-signal circuit node branching into two difference signal paths: a direct path to the difference-signal input node of said first summing circuit and a path via said inverter to a difference-signal input node of said second summing circuit.

14. The stereophonic signal processing system as defined in claim 5 wherein said first summing circuit, a corresponding first stereo-signal filter circuit and a corresponding first difference-signal filter circuit are combined in a first dual-transfer-function circuit module, implemented by a single op-amp device and associated passive components, and wherein said second summing circuit, a corresponding second stereo-signal filter circuit and a corresponding second difference-signal filter circuit are combined in a second dual-transfer-function circuit module, similar to the first dual-transfer-function circuit module.

15. A stereophonic signal processing system, for enhancing stereo performance of a compact stereo sound system, interposed in left and right stereo signal paths between a source providing a pair of stereo signals, designated L and R, and corresponding input ports of a stereo power amplifier driving stereo loudspeakers, said signal processing system comprising:

left and right input ports of said system receiving said stereo signals from the source;

left and right output ports of said system, driving the stereo power amplifier via the input ports thereof;

left and right low-bass high-pass filter circuits, receiving L and R stereo signals as inputs from the left and right input ports of the system respectively, configured and arranged to provide as outputs the low-bass filtered stereo signals L' and R' wherein low-bass frequency components of the stereo signals are attenuated in a predetermined manner to minimize reproduction distortion by minimizing low frequency signal components in the compact loudspeakers below an effective frequency range thereof;

a first resistor connected between the output node of said left low-bass high-pass filter circuit and the left output port of said system;

an inverter circuit having an input node connected to the output node of said right low-bass high-pass filter circuit, and having an output node providing as output an inverted right stereo signal;

a second resistor connected between the output node of said inverter and the right output port of said system; and a network of resistors and capacitors including said first and second resistors, configured and arranged to subtract the left and right stereo signals by adding the left signal to the inverted right signal, to thus provide a derived difference signal, to capacitively filter the derived difference signal and thus provide, via a pair of resistive circuit branches, upper-bass high-pass filtered left difference signal and right difference signals, and to separately sum such filtered left and right difference signals correspondingly with a filtered left stereo and an inverted filtered right stereo signals, and to provide a further right channel inversion so as to thus provide at said system output ports a spatially-enhanced right stereo output signal R' and a spatially-enhanced left stereo output signal L'.

16. A stereophonic signal processing system, for spatial enhancemeeent of reproduced sound in a compact stereo sound system having relatively small stereo loudspeakers driven by a stereo power amplifier, comprising:

first and second input ports receiving first and second stereo signals from a stereo signal source;

first and second output ports driving the stereo power amplifier;

a differential amplifier, receiving the first and second stereo signals as inputs, configured and arranged to subtract the second signal from the first signal so as to derive and provide therefrom a difference signal;

a difference-signal equalizer circuit configured and arranged to apply frequency-response shaping to the difference signal in accordance with a stepped low-boost equalizer function, providing an equalized difference signal at an equalizer output node;

an inverter circuit configured and arranged to invert the equalized difference signal and to thus provide an inverted equalized difference signal;

difference-signal filter means configured and arranged to filter the equalized difference signal and the inverted equalized difference signal in accordance with a high-pass filter function having a designated upper-bass cutoff frequency, thus providing an equalized filtered difference signal and an inverted equalized filtered difference signal;

stereo-signal filter means constructed and arranged to separately filter the first and second stereo signals in a like manner in accordance with a predetermined stereo high-pass filter transfer function having a cutoff frequency at a designated low-bass frequency that is lower than the upper-bass cutoff frequency by a predetermined amount, the low-bass cutoff frequency being chosen to minimize reproduction distortion by minimizing low frequency signal components below the effective frequency range of the small loudspeakers;

a first summing circuit configured and arranged to sum the the first stereo signal and the equalized filtered difference signal and to thus provide therefrom a first spatially-enhanced stereo output signal of said processing system; and a second summing circuit configured and arranged to sum the second stereo signal and the inverted equalized filtered difference signal and to thus provide therefrom a second spatially-enhanced stereo output signal of said processing system.

17. An audio signal process for enhancing the stereo performance in a compact stereo sound system wherein first and second stereo signals, processed according to the present invention, are delivered to a stereo power amplifier driving stereo loudspeakers that are relatively small and closely spaced, said process comprising the steps of:

(a) subtracting the second stereo signal from the first stereo signal in a differential amplifier circuit configured and arranged to receive as input the first and second stereo signals, so as to derive therefrom a difference signal wherein rejection of correlated stereo signal content is made to vary with frequency in a predetermined manner;

(b) applying frequency equalization to the difference signal so as to boost audio frequencies below a designated lower bass frequency region;

(c) inverting the equalized difference signal by inverter means so as to derive therefrom an inverted equalized difference signal;

(d) filtering the difference signal and the inverted equalized signal by a difference-signal high-pass filter function with a predetermined upper-bass cutoff frequency so as to provide a filtered equalized difference signal and a filtered inverted equalized difference signal;

(e) adding the first stereo signal and the filtered non-inverted equalized difference signal in a first summing circuit so as to thus provide, as a first output of said processing system, a first channel modified stereo output signal; and (f) adding the second stereo signal and the filtered inverted equalized difference signal in a second summing circuit so as to thus derive, as a second output of said processing system, a second channel modified stereo output signal.

18. The audio signal process as defined in claim 17 further comprising in step (d) the substep of:

(d1) filtering the first and second stereo signals by a corresponding pair of stereo-signal filter circuits having a high-pass transfer function with a low-bass cutoff frequency chosen to minimize reproduction distortion by minimizing low frequency signal components below an effective frequency range of the small loudspeakers.

19. An audio signal process for enhancing the stereo performance in a stereo sound system wherein first and second stereo signals, processed according to the present invention, are delivered to a dual stereo power amplifier driving stereo loudspeakers that are relatively small and closely spaced, said process comprising the steps of:

(a) subtracting the second stereo signal from the first stereo signal in a differential amplifier circuit receiving as input the first and second stereo signals, so as to derive therefrom a difference signal;

(b) applying frequency equalization to the difference signal so as to boost lower audio frequencies;

(c) inverting the equalized difference signal in an inverter so as to derive therefrom an inverted equalized difference signal;

(d) filtering the difference signal and the inverted equalized signal by a difference-signal high-pass filter function with a predetermined upper-bass cutoff frequency so as to provide a filtered equalized difference signal and a filtered inverted equalized difference signal;

(e) filtering the first and second stereo signals by a predetermined stereo high-pass filter function defining a predetermined low-bass cutoff frequency below an effective frequency range of the small loudspeakers, the low-bass frequency being chosen to minimize reproduction distortion by minimizing low frequency signal components below an effective frequency range of the small loudspeakers;

(f) adding the first stereo signal and the filtered non-inverted equalized difference signal in a first summing circuit so as to thus provide, as a first output of said processing system, a first channel modified stereo output signal; and (g) adding the second stereo signal and the filtered inverted equalized difference signal in a second summing circuit so as to thus provide, as a second output of said processing system, a second channel modified stereo output signal.

20. The audio signal process as defined in claim 19 further comprising in step (a) the substep of (a1) performing subtraction in a frequency dependent manner such that rejection of correlated stereo signal content in the difference signal is made to vary with frequency in a predetermined manner.

21. The audio signal process as defined in claim 20 wherein the rejection of correlated stereo signal content in the difference signal is made to be greater at frequencies above a predetermined midrange frequency compared to such rejection at frequencies below the predetermined midrange frequency.

* * * * *